US012397214B2

(12) United States Patent
Knapick

(10) Patent No.: US 12,397,214 B2
(45) Date of Patent: Aug. 26, 2025

(54) ALIGNMENT SYSTEM FOR PROPER SETTING OF GAME BOARDS

(71) Applicant: William R. Knapick, Coal Township, PA (US)

(72) Inventor: William R. Knapick, Coal Township, PA (US)

( * ) Notice: Subject to any disclaimer, the term of this patent is extended or adjusted under 35 U.S.C. 154(b) by 574 days.

(21) Appl. No.: 17/944,563

(22) Filed: Sep. 14, 2022

(65) Prior Publication Data

US 2023/0100748 A1 Mar. 30, 2023

Related U.S. Application Data

(60) Provisional application No. 63/249,207, filed on Sep. 28, 2021.

(51) Int. Cl.
*A63B 67/06* (2006.01)

(52) U.S. Cl.
CPC ..... *A63B 67/06* (2013.01); *A63B 2067/061* (2013.01)

(58) Field of Classification Search
CPC ..... A63B 67/06; A63B 2067/061; A63B 2225/02
See application file for complete search history.

(56) References Cited

U.S. PATENT DOCUMENTS

| | | | | |
|---|---|---|---|---|
| 11,173,363 | B1 | 11/2021 | Pontrelli | |
| 11,333,495 | B1 | 5/2022 | Caprio | |
| 2006/0061034 | A1* | 3/2006 | Poffenberger | A63F 11/0051 273/287 |
| 2008/0157476 | A1* | 7/2008 | Striebel | A63B 63/00 273/402 |
| 2011/0215528 | A1* | 9/2011 | Conville | A63B 67/06 273/402 |
| 2018/0043227 | A1* | 2/2018 | Segerstrom | A63B 67/06 |
| 2020/0298079 | A1 | 9/2020 | Mullins et al. | |
| 2020/0384327 | A1 | 12/2020 | McMahon | |
| 2021/0101059 | A1* | 4/2021 | Hudak | A63B 71/023 |

* cited by examiner

*Primary Examiner* — Jay Trent Liddle
(74) *Attorney, Agent, or Firm* — Wendy W. Koba

(57) ABSTRACT

An arrangement for aligning a pair of game boards as used in a tossing game such as cornhole, the arrangement including alignment fiducials located along a center line of each game board and an alignment system that uses a marking line that uses the fiducials to achieve alignment (and perhaps also proper spacing) between the pair of game boards. The marking line of the alignment system may be either a laser-based source or a non-elastic weighted string source.

5 Claims, 14 Drawing Sheets

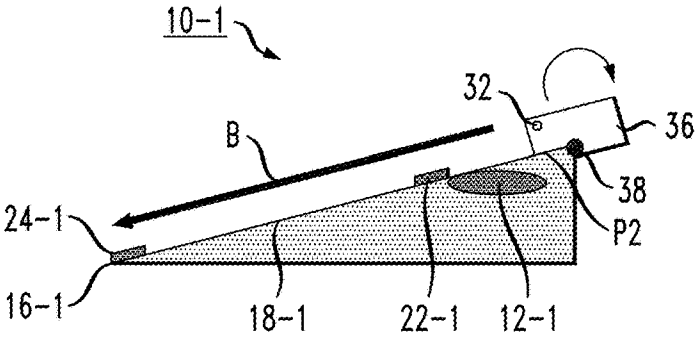
FIG. 5
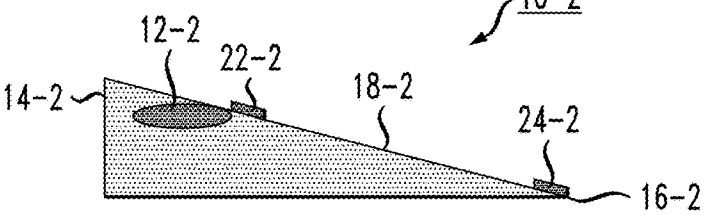
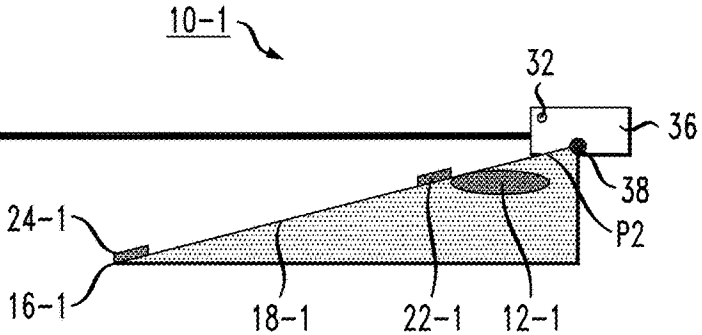
FIG. 6
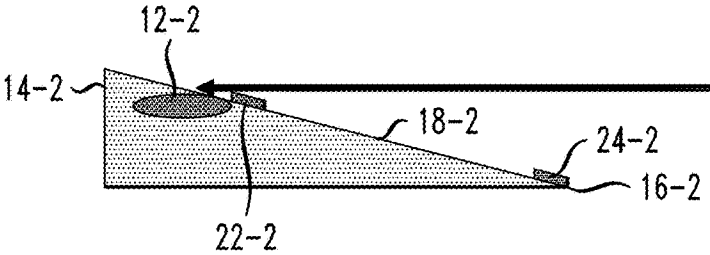

ALIGNMENT SYSTEM FOR PROPER SETTING OF GAME BOARDS

CROSS-REFERENCE TO RELATED APPLICATIONS

This application claims the benefit of U.S. Provisional Application No. 63/249,207, filed Sep. 28, 2021 and herein incorporated by reference.

FIELD OF THE INVENTION

The present invention relates to an alignment system useful in providing a proper positioning of game boards and, more particularly, to an alignment system that is able to properly align (and perhaps space) a pair of game boards, such as those used for cornhole or other tossing games.

BACKGROUND OF THE INVENTION

The game "cornhole" (or bean bag toss) uses a pair of game boards that are typically two feet wide and four feet long (for example). Each board includes a similarly-located circular opening, where each board is angled such that the edge of the board closer to the circular opening is raised higher than the opposing edge. The boards are spaced a distance from each other so that at least two people or players each attempt to toss corn-filled bags (or bags filled with any other suitable material) through the circular opening in the opposing board. The front (lower) edges of the boards are usually spaced about twenty-seven feet apart from each other, although other separations may obviously be used.

While it is generally relatively straightforward to mark off the desired separation between the boards, the ability to align the pair of boards such that they remain parallel to each other and their respective circular openings are aligned is oftentimes merely "eye-balled", which is not a preferable technique, particularly for game boards spaced tens of feet apart (or more).

SUMMARY OF THE INVENTION

Disclosed is a system that provides proper alignment between a pair of game boards by including alignment fiducials on a top surface of each board and use a controlled alignment mechanism (e.g., laser beam, reeled cording, or the like) to ensure proper alignment between the boards. The same alignment mechanism may also be used to ensure a proper separation between the game boards prior to play.

In accordance with the principles of the present invention, each game board is configured to include a pair of alignment fiducials, a first fiducial marking a midpoint of the game board opening and a second fiducial marking a midpoint of a front edge of a wedge-shaped game board (the "front edge" being the edge of the playing surface closest to the ground). In one embodiment, a laser light source is used to create an output beam that passes across both alignment fiducials of a first board. A second game board is then positioned so that this same light beam passes across the alignment fiducials of the second board. A reflection element may be included in the second game board, used to the reflect the light beam back to the source, where the time-of-flight measurement may be used to ensure a proper spacing between the two boards.

In an alternative embodiment, a non-elastic string (e.g., Kevlar) may be used to perform the alignment, with a proximal end of the string attached to the underside of a first game board in the vicinity of the hole so that the string exits the hole and is oriented to cross over both alignment fiducials. The non-elastic string comprises a second, weighted distal termination, where the length of the string is selected to be a defined length for a particular game (e.g., twenty-seven feet for a game of cornhole). The weight distal termination is passed through the hole of a second board, where the pair of boards are separated until the non-elastic string becomes taut, defining the proper separation. The positioning of the second board is rotated until both alignment fiducials are positioned directly under the non-elastic string. In a preferred embodiment, a pair of plumb bobs are included along the non-elastic string and positioned to be directly above a proper location for the front-edge fiducial of each board. Thus, the positioning of each board may be slightly adjusted until the fiducials and plumb bobs are aligned.

Indeed, the present invention may be defined as taking the form of an arrangement for providing a defined placement between a pair of game boards used in playing a tossing game, the alignment system comprising alignment fiducials formed on each game board and an alignment system that utilizes these fiducials to create alignment, and in some embodiments a proper spacing, between game boards. The alignment fiducials in particular may comprise a pair of alignment fiducials formed on a top game surface of each game board, a first alignment fiducial disposed at a midpoint of a front edge of an associated game board and a second alignment fiducial disposed at a midpoint of a central opening formed through the top game surface. The alignment system is configured to be releasably coupled to a first game board of the pair of game boards and includes a marking line extending outward along a first positioning location over the pair of alignment fiducials on the first game board to create alignment therebetween, the marking line further extending to the second game board of the pair of game boards and to a second positioning location over the pair of alignment fiducials on the second game board, so as to create alignment between the first game board and the second game board.

Other and further aspects and embodiments of the present invention will become apparent during the course of the following discussion and by reference to the accompanying drawings.

BRIEF DESCRIPTION OF THE DRAWINGS

Referring now to the drawings, where like numerals represent like parts in several views:

FIG. 5 is a side view of the arrangement as depicted in FIG. 3, showing the positioning of the alignment system into a first pivot location to achieve proper configuration of the alignment system with respect to that game board (the near game board);

FIG. 6 is a side view of the arrangement as depicted in FIG. 4, showing the positioning of the alignment system into a second pivot location to achieve proper positioning of the pair of game boards;

DETAILED DESCRIPTION

Figure 1:
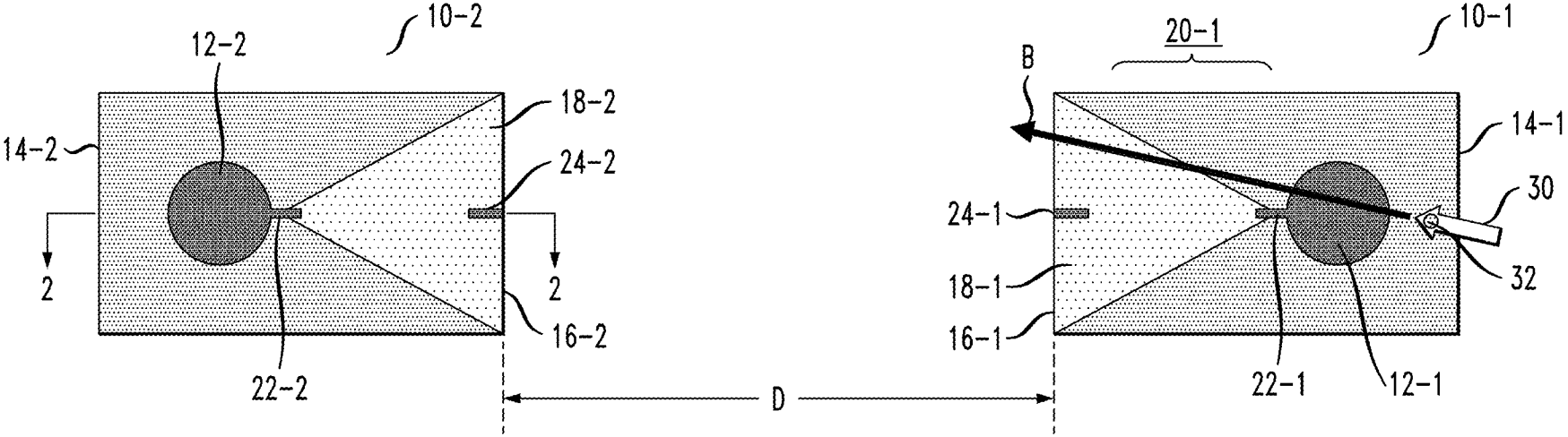
FIG. 1 is a top view of a pair of game boards, formed in accordance with the present invention to include a pair of alignment fiducials disposed at central positions of the game surface, with the inventive alignment system attached to one of the game boards as well.
Figure 2:
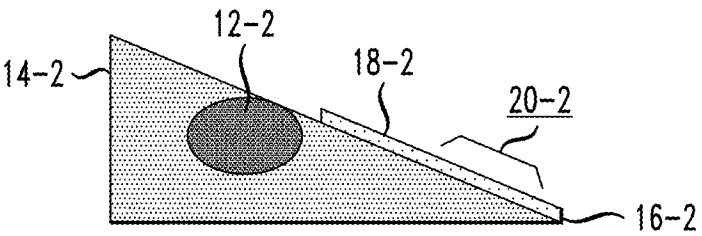
FIG. 2 is a side view of a game board as shown in FIG. 1.
Figure 3:
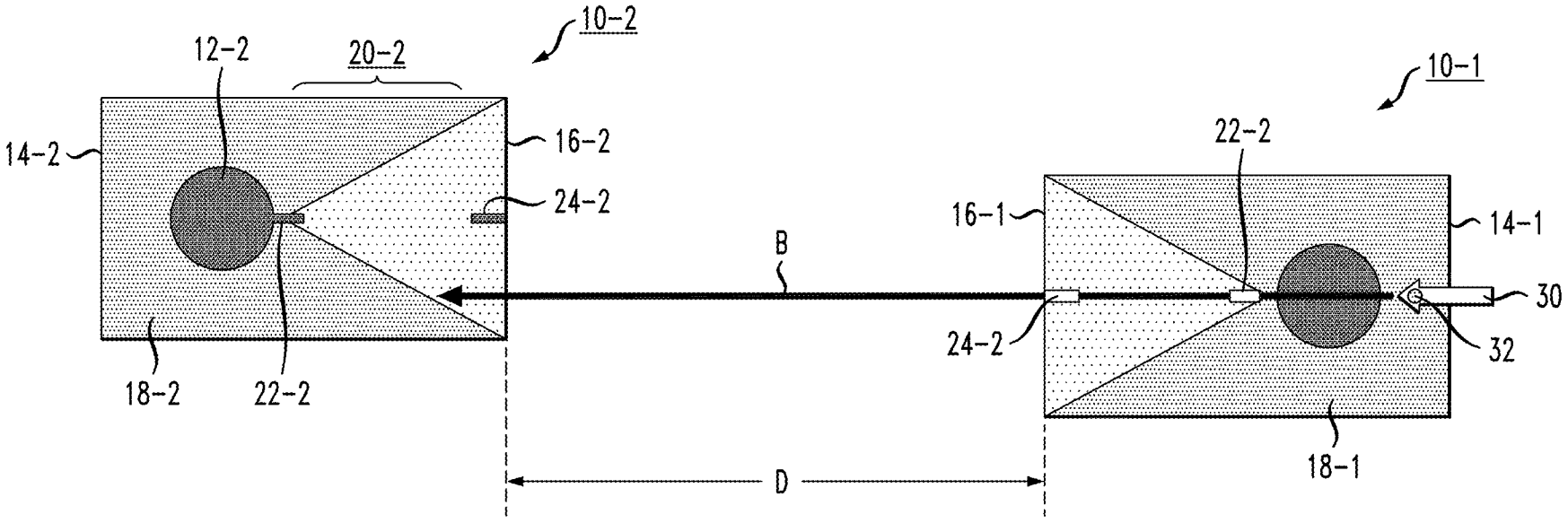
FIG. 3 is another view of the arrangement of FIG. 1, illustrating the misalignment of one game board with respect to the other.
Figure 4:
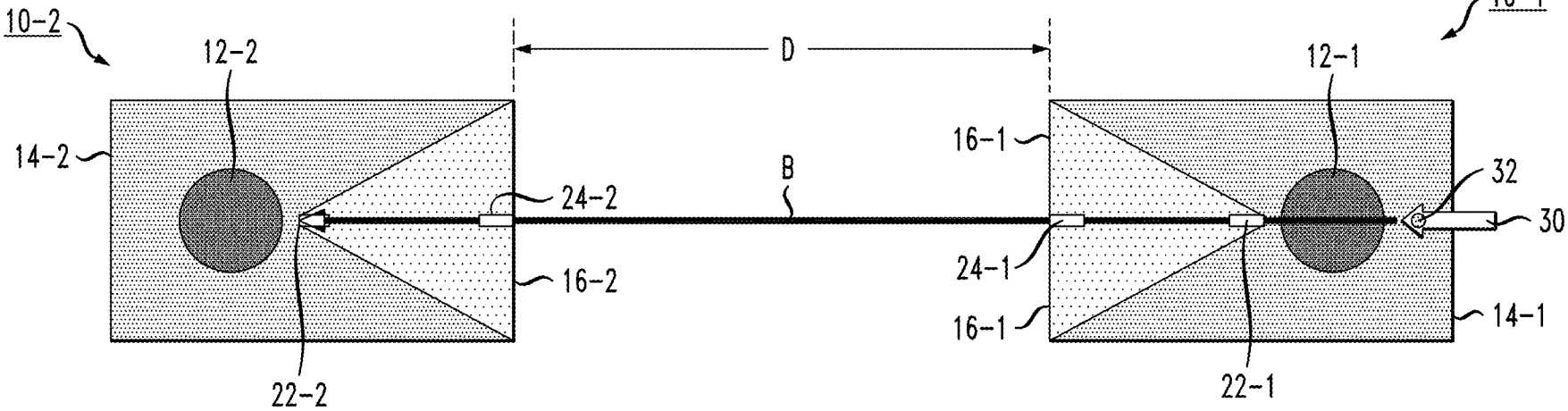
FIG. 4 is yet another view of the arrangement of FIG. 1, in this case illustrating the final alignment as achieved between the pair of game boards by using the inventive arrangement of the alignment fiducials in combination with the alignment system.

FIGS. 1, 3, and 4 contain top diagrammatic views of a pair of game boards 10-1, 10-2 that are aligned using the fiducial-based alignment system formed in accordance with the teachings of the present invention. As discussed below, a first embodiment takes the form of a laser-based alignment system 30, used to achieve a proper configuration of the pair of boards. FIG. 2 is a side view of a game board 10. It is to be understood that the elements as depicted in FIGS. 1-4 are not to scale, but are shown merely to best illustrate the features of the present invention.

FIG. 1 is a top view of a pair of corn hole game boards 10-1, 10-2, depicting a typical arrangement prior to beginning a game. Each game board 10 includes a central opening 12, and is defined as having a rear (upper) edge 14 and a forward (lower) edge 16. FIG. 2 is a cut-away side view of game board 10-2, taken along line 2-2 of FIG. 1, where the side view in FIG. 2 clearly illustrates the difference in elevation between rear edge 14 and forward edge 16. Game board 10 may be defined as including a game surface 18, with central opening 12 formed through surface 18 and directed downward. In accordance with the principles of the present invention, and discussed in more detail below, each game surface 18 also includes a pair of alignment fiducials 20. The pair of alignment fiducials 20 consists of a first fiducial 22 located at a midpoint of central opening 12 and a second fiducial 24 located at a midpoint of forward edge 16. It is necessary for first fiducial 22 and second fiducial 24 to fall across the same center line (which is parallel to edges 11, 13 of board 10). The pair of alignment fiducials 20 may consist of vertical lines (as shown in FIG. 1), or a pair of X's, or any other means of marking game surface 18.

In looking at FIG. 1, it is immediately apparent from this top view that game board 10-2 is not in alignment with game board 10-1. While the mis-alignment between the boards is apparent in this diagram, when looking at an actual cornhole playing field with a separation distance D between the boards that is typically greater than about twenty-five feet, it may be difficult to determine whether or not the boards are aligned. The alignment system of the present invention (both the laser-based embodiment described immediately below and the weighted string-based embodiment described thereafter) address this problem by the use of alignment fiducials added to the top surfaces of each game board.

In particular, an initial step in the laser-based embodiment of the inventive alignment is shown in FIG. 1, where a laser-based alignment system 30 is attached along upper edge 14-1 of game board 10-1. Once in position, a laser light source 32 within alignment system 30 is activated to produce an output beam B that is first directed along game surface 18-1. As shown, output beam B from laser light source 32 is not in proper alignment with alignment fiducials 22-1, 24-1 on game board 10-1. Thus, a next step in the alignment process is to adjust the position of laser-based alignment system 30 (e.g., pivot to the left or the right—in the illustrated "top view" the pivot directions are obviously up and down) until laser beam B falls directly over alignment fiducials 22-1, 24-1. The result of this initial alignment step is shown in FIG. 3.

Once this "near board" alignment is secured, laser-based alignment system 30 is rotated upward into a position parallel to the ground so as to direct output beam B toward the remotely-located ("far board") game board 10-2. As shown in FIG. 3, the output beam B that is perfectly aligned with game board 10-1 "misses" the center of game board 10-2 by a significant amount. Therefore, in order to finalize the alignment, game board 10-2 is moved (while maintaining the desired separation D) until output beam B also falls across alignment fiducials 22-2 and 24-2. FIG. 4 shows the final step in the laser-based alignment process.

FIGS. 5 and 6 contain side views of game boards 10-1 and 10-2, particularly illustrating the rotation of laser-based alignment system 30 between the near-board alignment step (discussed above in association with FIG. 3) and the far-board alignment step (discussed above in association with FIG. 4). In particular, FIG. 5 is a side view of the arrangement of game boards 10-1 and 10-2, particularly illustrating the positioning of laser-based alignment system 30 (here, attached to game board 10-1) so as to shine output beam B along game surface 18-1 of game board 10-1. With laser-based alignment system 30 in this position, it may be rotated left or right to align output beam B with alignment fiducials 22-1 and 24-1. Once this alignment is achieved, laser-based alignment system 30 is pivoted upward (indicated by the clockwise arrow in FIG. 5) so that its beam is directed toward game board 10-2. This position of laser-based alignment system 30 is shown in FIG. 6. In reviewing FIGS. 5 and 6, the movement of alignment system may be clearly understood, being moved (via a pivot point P, for example) between illuminating near game board 10-1 (denoted as pivot position P1) and illuminating far game board 10-2 (denoted as pivot position P2).

Figure 7:
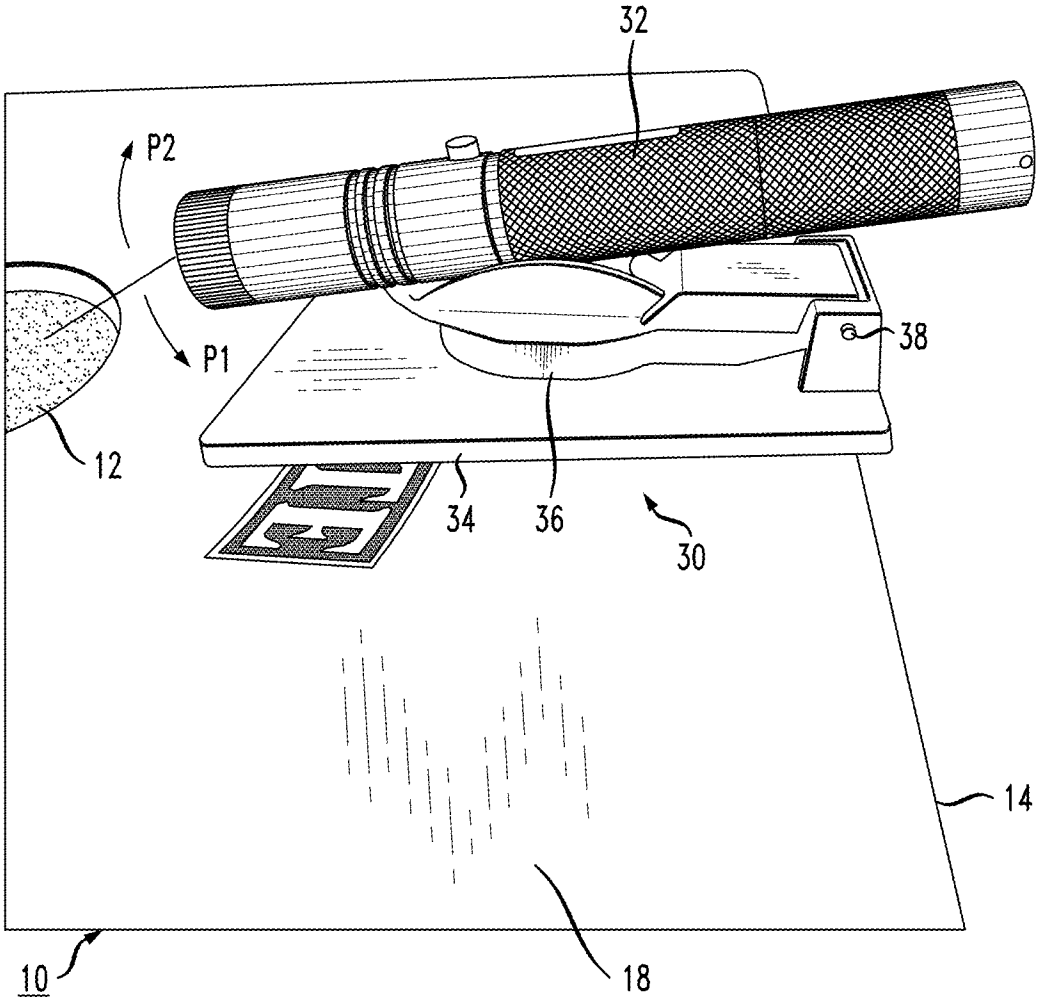
FIG. 7 is a close-up side view of an exemplary laser-based alignment system disposed in the first pivot location.
Figure 9:
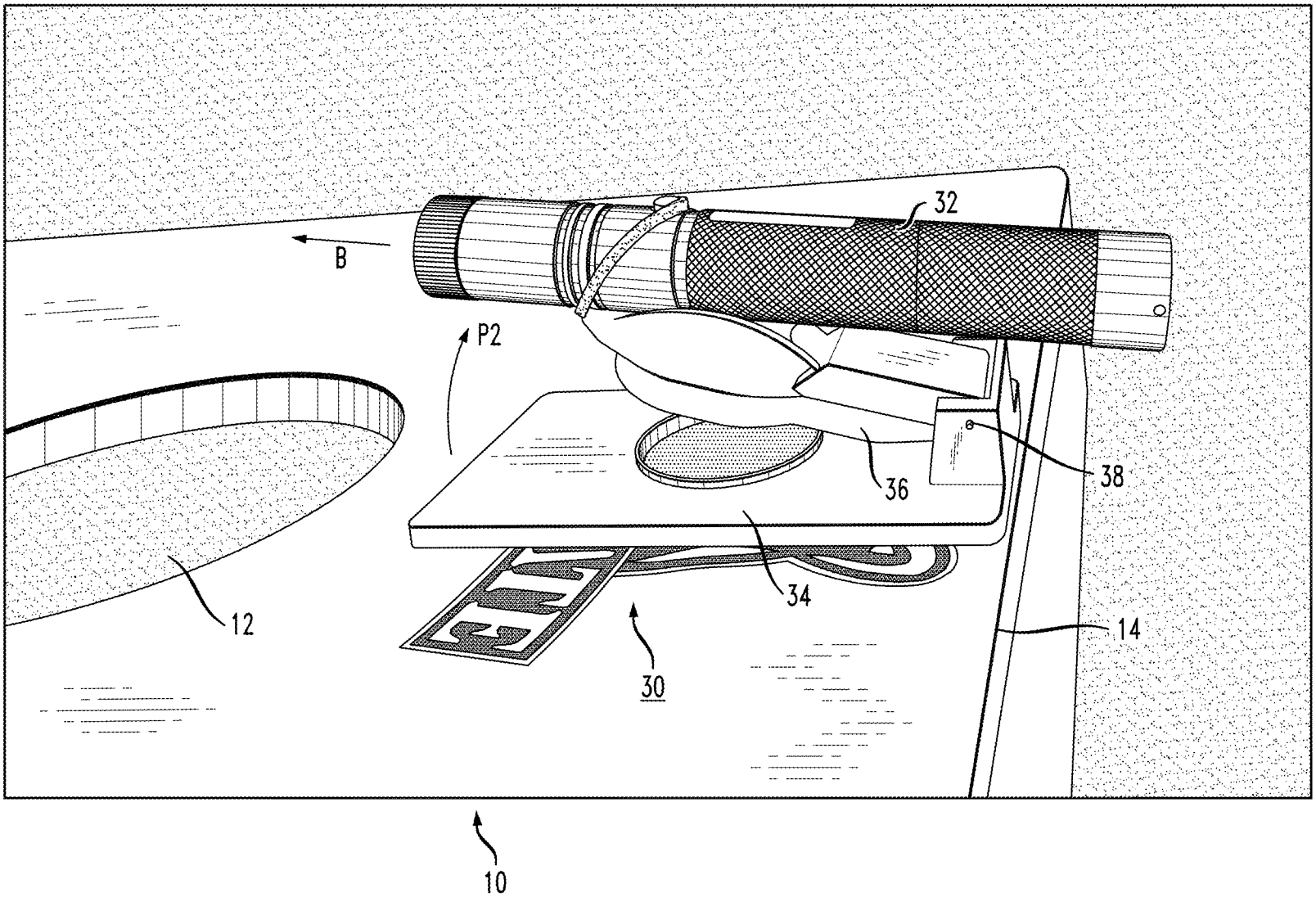
FIG. 9 is a close-up side view of the exemplary laser-based alignment system disposed in the second pivot location.

FIG. 7 is a close-up side view of a particular configuration of laser-based alignment system 30 as positioned along upper edge 14 of game board 10. As shown in this view, laser-based alignment 30 includes a support member 34 that is positioned on game surface 18 of game board 10 and is perhaps clamped or otherwise removably affixed to upper edge 14 of game board 10. Laser light source 32 is shown as attached to support member 34 via a lever arm 36. Lever arm 36 is coupled to a pivot member 38 and used to pivot laser light source 32 between pivot position P1 (as shown in FIG. 7) and pivot position P2 (as shown in FIG. 9). Various arrangements and materials may be used for support member 34, lever arm 36, and pivot member 38. Moreover, an additional layer of gripping/protective material may be used between support member 34 and surface 18 of game board 10 to ensure that support member 34 does not shift once in position.

Figure 8:
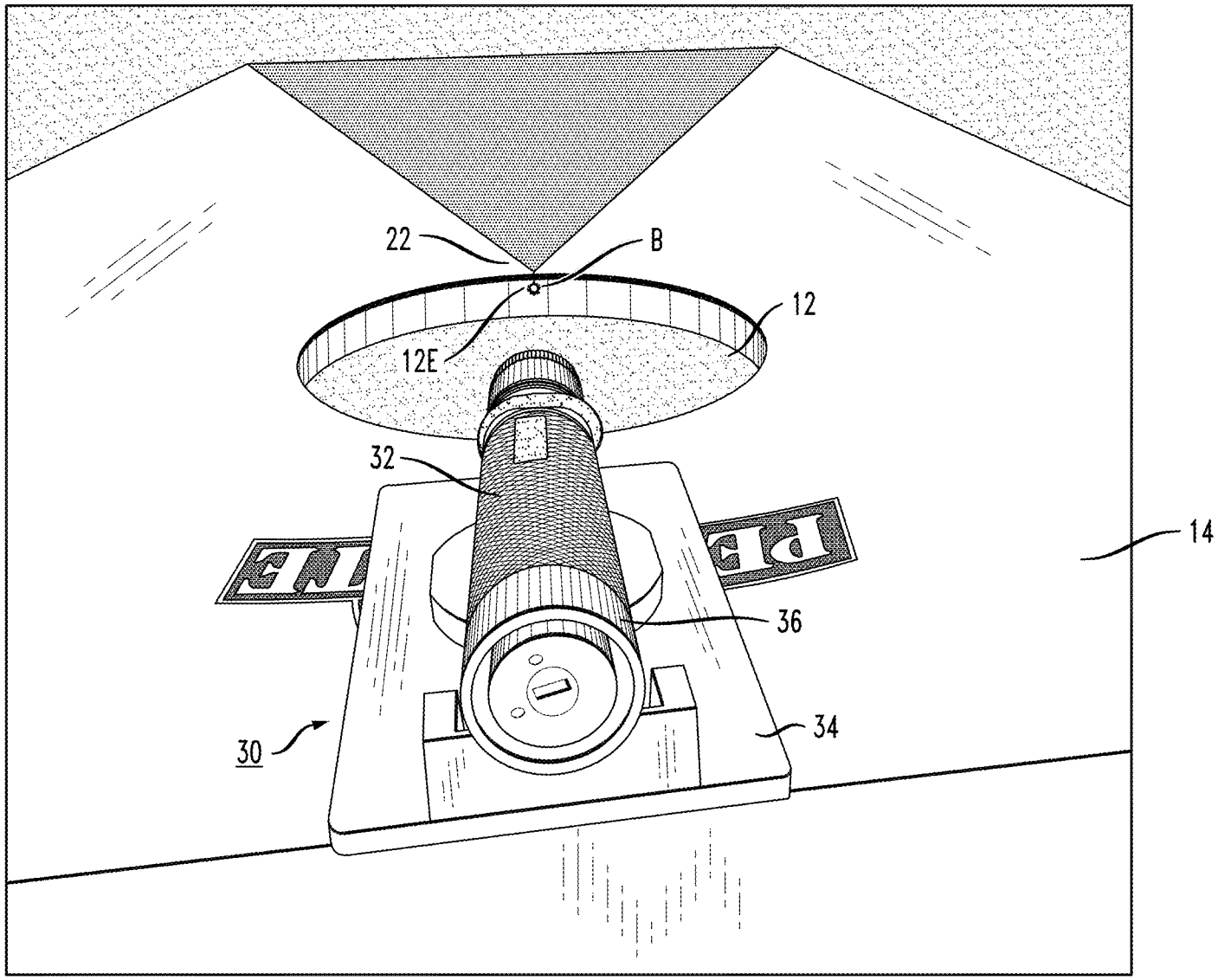
FIG. 8 is a rear view of the depiction of FIG. 7, illustrating the alignment between the output laser beam and the alignment fiducial.
Figure 10:
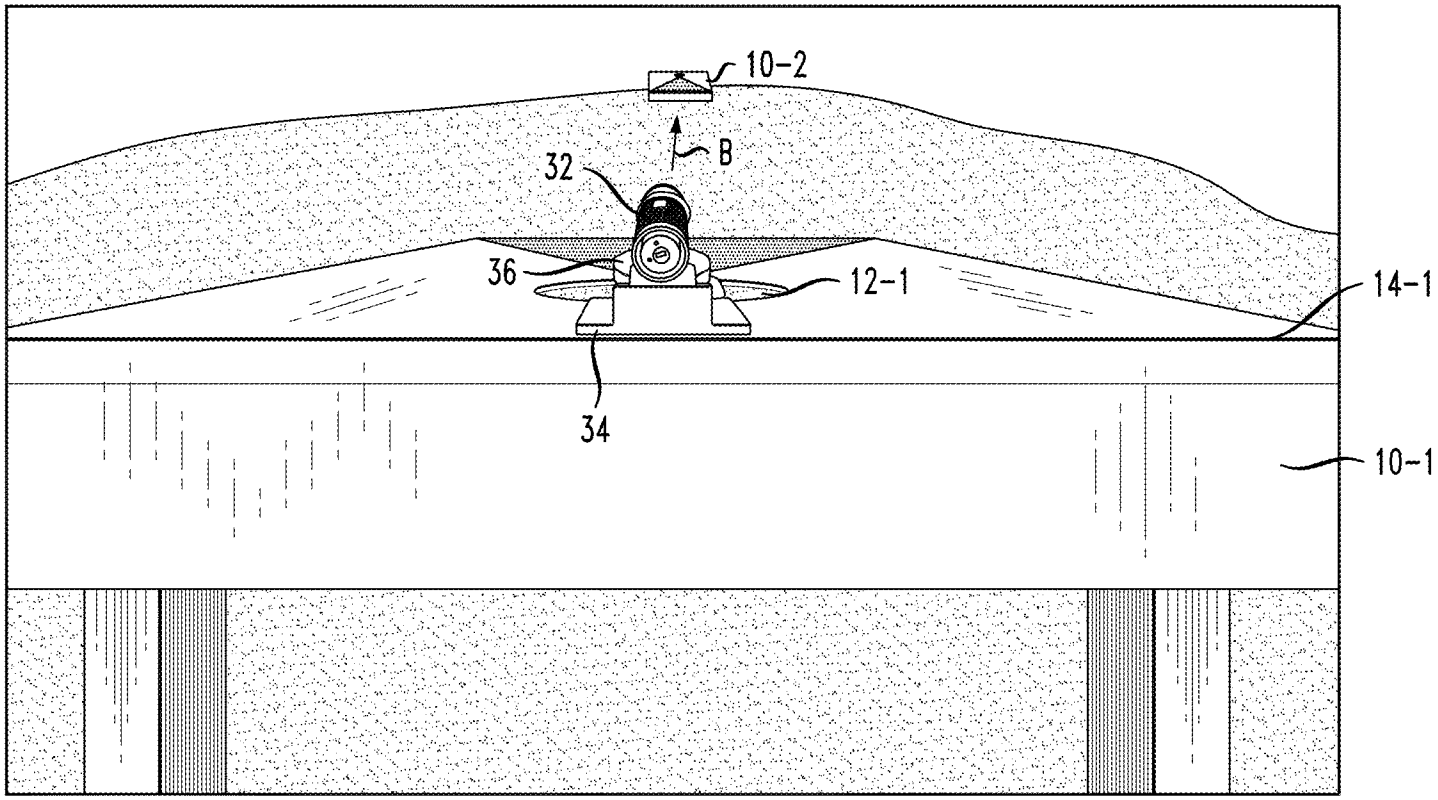
FIG. 10 is a view of a pair of game boards from behind the laser-based alignment system in the second pivot location, indicating the direction of propagation for the output laser beam from the near game board toward the far game board.
Figure 11:
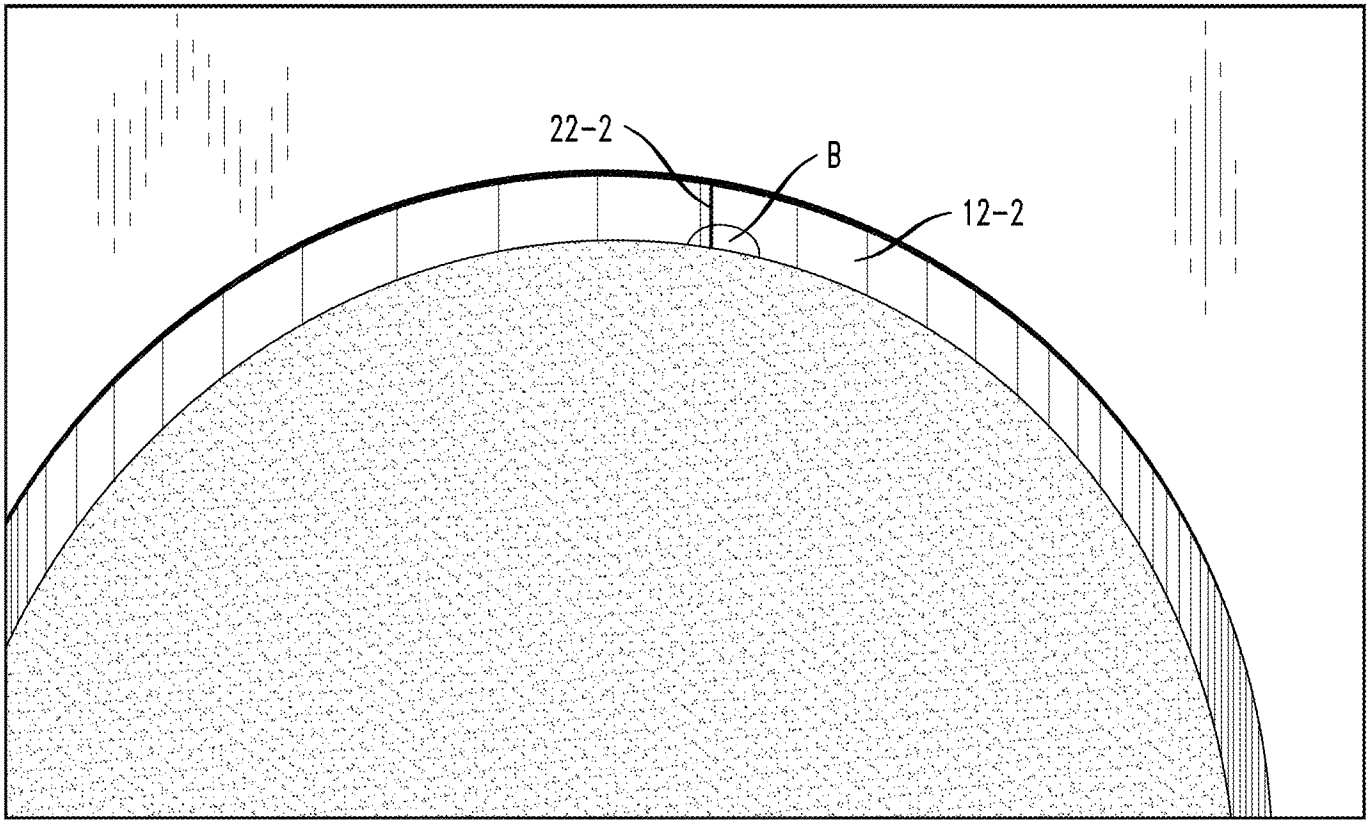
FIG. 11 is a close-up view of the central opening of the far game board, illustrating the alignment between the output laser beam and the alignment fiducial.

FIG. 8 is another view of the configuration of FIG. 7. Here again, laser-based alignment system 30 is positioned so that the output beam B from laser source element 32 illuminates alignment fiducial 22 on central opening 12, thus confirming that laser-based alignment system 30 is in alignment with the "near" game board upon which it is mounted. Again, in performing this initial alignment, lever arm 36 is in the lowered position P1, so that the output beam B from laser light source 32 is directed downward along the "near" game board. FIG. 9 illustrates the next step in the alignment process, where lever arm 36 is moved into position P2 so that output beam B from laser light element 32 is directed outward toward a "far" game board (not shown). FIG. 10 is a view from behind a game board 10-1, showing the positioning of laser-based alignment system 30 and the direction of output beam B toward far game board 10-2. FIG. 11 is a close-up view of output beam B as it illuminates alignment fiducial 22-2 along central opening 12-2 of a "far" game board 10-2, affirming that the boards are now in alignment and the game may begin.

Figure 12:
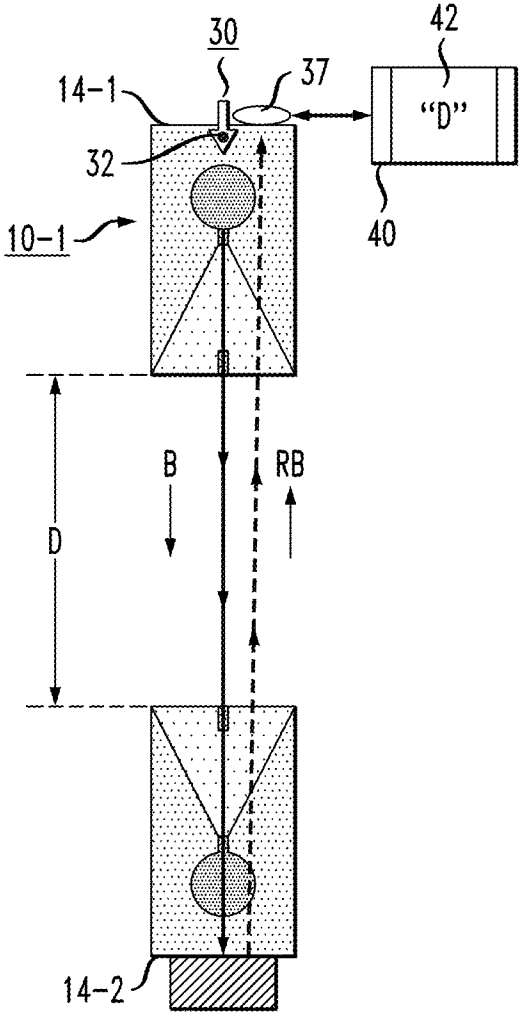
FIG. 12 contains a top view of a diagram illustrating an embodiment of the present invention that utilizes reflections from the laser beam source to perform a measurement of the separation between the pair of game boards.

As mentioned above, various embodiments of the present invention may also be equipped to assist in the initial step of positioning the pair of game boards with the desired amount of separation between them (typically twenty-seven feet). FIG. 12 is a top view of the pair of game boards 10-1, 10-2 configured in a manner that explains this additional feature of creating a proper separation (D) between the boards. As with the aspects of the present invention described above, laser-based alignment system 30 is shown as attached along an upper edge 14 of a board. In this example, laser-based alignment system 30 is attached to first game board 10-1, with laser light source 32 pivoted into position P2 (as shown in FIGS. 6 and 9, for example) so as to direct output beam B toward second game board 10-2. In accordance with this further embodiment, game board 10-2 is equipped with a reflective surface 35 (such as a mirror) that is affixed to a defined reference surface of the game board. In this case, mirror 35 is attached to upper edge 14-2 of second game board 10-2. When output beam B impinges mirror 35, it will be re-directed as a reflected beam RB back towards game board 10-1.

Laser-based alignment system 30 is configured in this particular embodiment to include a photodetecting device 37, which will capture the reflected light RB from mirror 35 of game board 10-2. Using well-known telemetry techniques, the time-of-flight and power level of the reflected beam may be calculated by a processor 40 to determine the separation between alignment system 30 and mirror 35, where the value of calculated separation may be displayed on a monitor 42 associated with processor 40. The separation between game board 10-2 and game board 10-1 may then be adjusted until monitor 40 displays the desired separation D.

Figure 13:
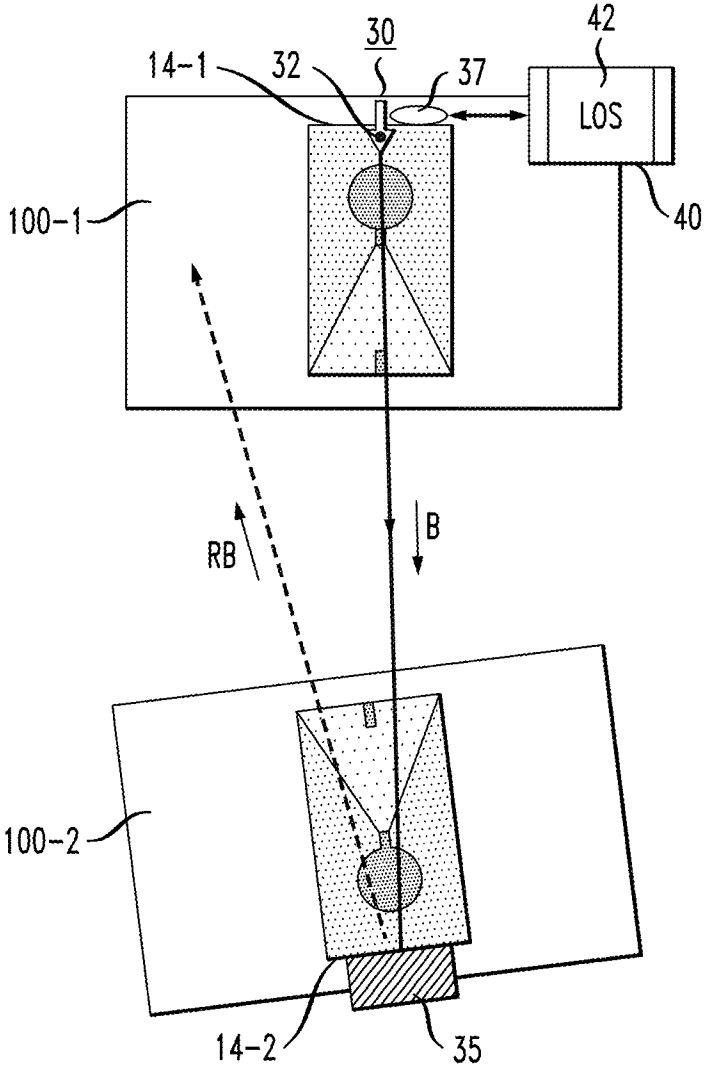
FIG. 13 contains a top view of the diagram of FIG. 12, where the arrangement also includes a pair of rotational mounts and a control coupling between the mounts that utilizes the reflected beam to maintain rotational alignment between the game boards.

FIG. 13 illustrates another feature of this embodiment of present invention. In this case, laser-based alignment system 30 may be re-activated from time-to-time (or perhaps left "on" continuously) to monitor the state of alignment between the game boards as they are being used. If a mis-alignment occurs, such as shown in FIG. 13, photodetecting device 37 will no longer receive reflected beam RB. The "loss of signal" (LOS) may trigger an alarm to alert that players than a re-adjustment of game board 12-2 is required. By virtue of using photodetecting device 37 for this purposes, the adjustment may be quickly made before any further mis-alignment may take place.

The adjustment of game board 10-2 with respect to game board 10-1 may be performed manually, of course. Alternatively, game boards 10 may be attached to mechanized rotatable mounts 100, where a mis-alignment alert may be utilized to automatically rotate one mount with respect to the other until alignment is re-established. The latter approach is particularly illustrated in FIG. 13. When photodetecting device 37 recognizes an LOS (by virtue of reflected beam RB angled off in a different direction), this LOS information may be transmitted from photodetecting device 37 to processor 40. Processor 40 uses this information to generate a control signal C that is sent to rotatable mount 100-2, which in turn activates mount 100-2 to rotate until both game boards are again in alignment.

In a somewhat more economical alternative embodiment of the present invention, a non-elastic, weighted string alignment system may be used in combination with the alignment fiducials in the same manner as that described above to provide alignment between a pair of game boards. FIGS. 14-17 illustrate this embodiment.

Figure 14:
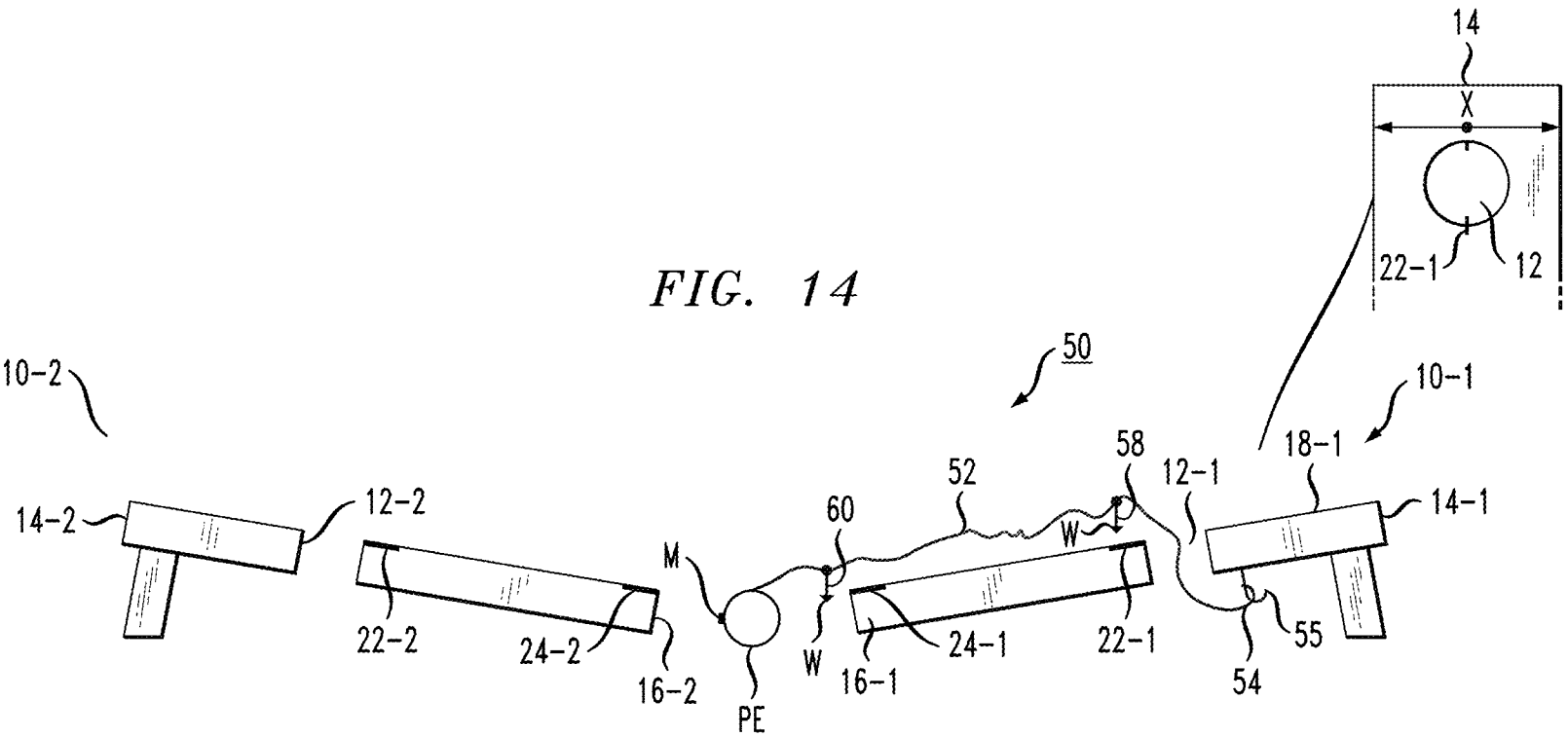
FIG. 14 illustrates another embodiment of the present invention, in this case using a non-elastic, weighted string alignment system, in combination with the alignment fiducials to perform alignment of the game boards.
Figure 15:
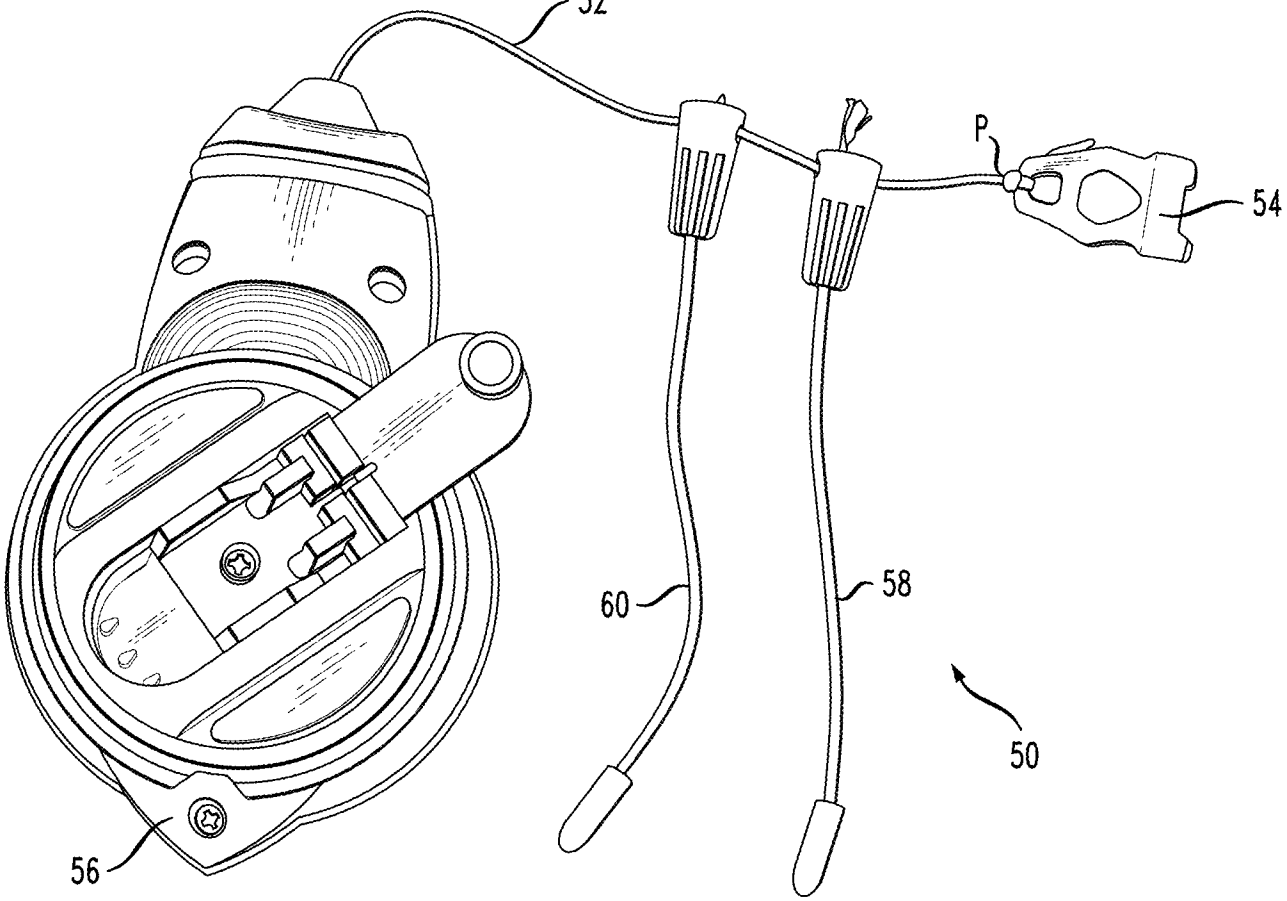
FIG. 15 is a close-up view of the various elements forming the non-elastic, weighted string alignment system.

FIG. 14 is a side view of game boards 10-1, 10-2 as described above. However, in this example a non-elastic, weighted string alignment system 50 is used to provide alignment (and proper separation) between game board 10-1 and game board 10-2. FIG. 15 illustrates alignment system 50, which includes a non-elastic string 52 with a hook 54 (or other type of fastener) positioned at a proximal end PE of non-elastic string 52. A counterweight 56 is positioned to support an opposing, distal termination of non-elastic string 52. In accordance with this embodiment of the present invention, a distance marker M (perhaps of a particular color) is made along non-elastic string 52 to indicate the desired separation (D) between game boards 10-1 and 10-2. Said another way, non-elastic string 52 includes a marker M that is positioned at a distance D from hook 54.

A configuration where non-elastic string 52 is payed out from a take-up reel allows for the reel to be used as counterweight 56. Also shown in FIG. 15 is a pair of plumb bobs 58, 60. As will be discussed below, plumb bobs 58, 60 are positioned over the alignment fiducials 22 of game boards 10-1 and 10-2 to ensure that the boards are oriented properly with respect to each other.

Referring back now to FIG. 14, weighted string alignment system 50 is shown as initially attached to game board 10-1. In this example, hook 54 is coupled to a mating element 55 disposed on the underside of game surface 18-1, in particular in proximity to central opening 12-1 and at its midpoint so as to be located at the midpoint X of surface 18-1. An inset to FIG. 14 is an underside view of a portion of game surface 18-1 and central opening 12-1, clearly illustrating the placement of mating element 55. Once hook 54 is secured to mating element 55, non-elastic string 52 is pulled through central opening 12-1, as shown. In this view, game boards 10-1 and 10-2 have not yet been properly spaced or aligned, with a following step being to insert counterweight 56 through central opening 12-2 of game board 10-2. Since the spacing is not proper in the configuration as shown in FIG. 15, string 52 is extremely slack.

Figure 16:
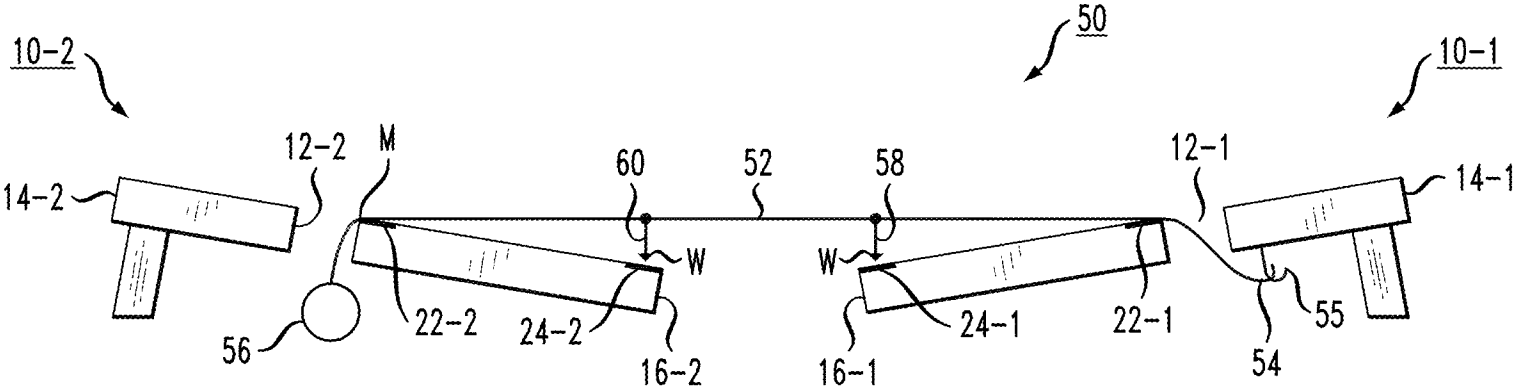
FIG. 16 illustrates an exemplary deployment of the non-elastic, weighted string alignment system to achieve proper spacing and alignment between the pair of game boards.
Figure 17:
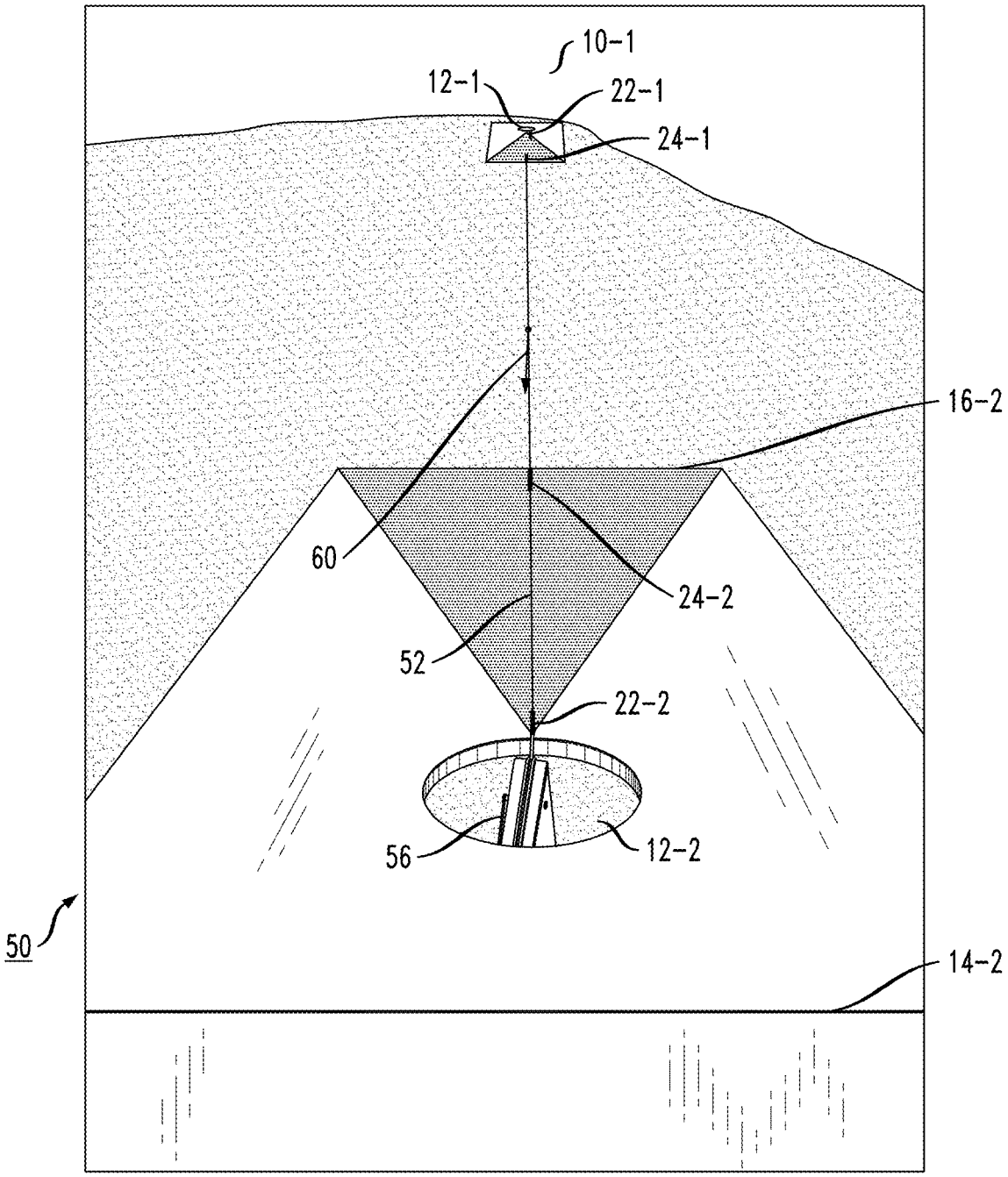
FIG. 17 is an isometric view from the upper edge of a near game board, illustrating the positioning of the non-elastic, weighted string alignment system with respect to the alignment fiducials on both the near game board and the far game board.

FIG. 16 shows a next step in the alignment process, where the distal end of non-elastic string 52 (i.e., the end comprising counterweight 56) is inserted through central opening 12-2 of game board 10-2. Game board 10-2 is then moved with respect to game board 10-1 until non-elastic string 52 is taut and distance marker M is positioned over alignment fiducial 22-2 of game board 12-2. Plumb bobs 58 and 60 are then positioned at defined locations for front edge fiducials 24-1 and 24-2, respectively. Game boards 10-1 and 10-2 are thereafter adjusted (i.e., slightly rotated), if necessary, so that weights Won plumb bobs 58, 60 are aligned with fiducials 24. FIG. 17 is an isometric view of game boards 10-1 and 10-2 aligned using the weighted string approach, illustrating the separation and alignment processes that may be achieved by using the weighted string embodiment of the alignment system of the present invention.

While the invention has been described with reference to preferred and example embodiments, it will be understood by those skilled in the art that a variety of modifications, additions and deletions are within the scope of the invention.

What is claimed is:

1. An arrangement for providing a defined placement between a pair of game boards used in playing a tossing game, the alignment system comprising a pair of alignment fiducials formed on a top game surface of each game board, a first alignment fiducial disposed at a midpoint of a front edge of an associated game board and a second alignment fiducial disposed at a midpoint of a central opening formed through the top game surface;

an alignment system for releasably coupling to a first game board of the pair of game boards, the alignment system including a marking line extending outward along a first positioning location over the pair of alignment fiducials on the first game board to create alignment therebetween, the marking line further extending to the second game board of the pair of game boards and to a second positioning location over the pair of alignment fiducials on the second game board, so as to create alignment between the first game board and the second game board;

wherein the alignment system comprises a laser-based alignment system, including a laser light source for generating an output beam as the marking line.

2. The arrangement as defined in claim 1 wherein the laser-based alignment system further comprises a support member releasably attachable to the game surface of the first game board, where the laser light source is attached to the support member through a pivoting level plate, the pivoting level plate configured to direct the laser light source along the first positioning location in a first pivot state and along the second positioning location in a second pivot state.

3. The arrangement as defined in claim 1 wherein the laser-based alignment system further comprises a reflective telemetry configuration for measuring a spacing between the first game board and the second game board, the reflective telemetry configuration comprising a reflective element mounted on the second game board and disposed to intercept the output beam from the laser light source and redirect it back to the laser-based alignment system;

a photodetecting device for receiving and measuring the redirected output beam; and a processor, responsive to the photodetecting device for calculating time-of-flight information and determining the spacing between the first game board and the second game board.

4. The arrangement as defined in claim 3, further comprising:

a first rotational mount disposed to support the first game board; and a second rotational mount disposed to support the second game board, wherein the processor is responsive to a loss-of-signal output from the photodetecting device and is further configured to transmit a rotational control signal to the second rotational mount for readjusting the position of the position of the second game board with respect to the first game board until the photodetecting device again receives the redirected output beam, indicating that realignment is achieved.

5. The arrangement as defined in claim 1, wherein the tossing game is a cornhole game using a pair of angled game boards.

* * * * *